US007312699B2

(12) United States Patent
Chornenky

(10) Patent No.: US 7,312,699 B2
(45) Date of Patent: Dec. 25, 2007

(54) EAR ASSOCIATED MACHINE-HUMAN INTERFACE

(76) Inventor: T. Eric Chornenky, 125 Cambridge Rd., Bethel Park, PA (US) 15102

( * ) Notice: Subject to any disclaimer, the term of this patent is extended or adjusted under 35 U.S.C. 154(b) by 391 days.

(21) Appl. No.: 10/816,508

(22) Filed: Apr. 1, 2004

(65) Prior Publication Data

US 2005/0238194 A1 Oct. 27, 2005

Related U.S. Application Data

(60) Provisional application No. 60/459,289, filed on Apr. 1, 2003.

(51) Int. Cl.
*G08B 1/08* (2006.01)

(52) U.S. Cl. ..... 340/539.1; 340/825.72; 381/381; 378/114; 345/156

(58) Field of Classification Search ..... 340/539.1, 340/575, 573.1, 576, 825.72; 381/381; 378/114, 378/110; 250/338.1; 382/1, 118; 715/863, 715/719; 345/8, 7, 157, 168, 156
See application file for complete search history.

(56) References Cited

U.S. PATENT DOCUMENTS

| | | | | |
|---|---|---|---|---|
| 5,091,926 | A * | 2/1992 | Horton et al. | 378/114 |
| 5,677,834 | A * | 10/1997 | Mooneyham | 700/83 |
| 6,091,832 | A * | 7/2000 | Shurman et al. | 381/381 |
| 6,184,863 | B1 * | 2/2001 | Sibert et al. | 345/156 |
| 6,345,111 | B1 * | 2/2002 | Yamaguchi et al. | 382/118 |
| 6,424,410 | B1 * | 7/2002 | Pelosi | 356/139.03 |
| 6,806,847 | B2 * | 10/2004 | Nixon et al. | 345/2.1 |

* cited by examiner

*Primary Examiner*—Anh V. La
(74) *Attorney, Agent, or Firm*—James Ray & Assoc.

(57) ABSTRACT

A human-machine interface can detect when a user's ear is pulled back to initiate a plurality of procedures. Such procedures include turning on a TV using a laser attached to the user, starting an additional procedure by speaking a command, communicating with other users in environments which have high ambient noise, and interacting with the internet. Head position sensors are used to detect the position of the head of a user and to either initiate a procedure if a characteristic of the head position or positions meets a certain criteria, or to pass the head position information to another device.

16 Claims, 6 Drawing Sheets

EAR ASSOCIATED MACHINE-HUMAN INTERFACE

This application claims the benefit of U.S. Provisional Application No. 60/459,289 filed Apr. 1, 2003.

FIELD OF THE INVENTION

The present invention generally relates to a human-machine interface structure and method.

BACKGROUND OF THE INVENTION

There are many human activities which can be made possible or made easier using a human-machine interface wherein a human can select certain options, such as turning a TV on or off, without having to use his or her hands, communicate with a computer using only his or her voice. Also, information about the condition of a person such as heart rate for example can be monitored without restricting the movements of the person.

Human-machine interface structures are known in the art. For example U.S. Pat. No. 6,696,973 to Ritter et al., and the references cited therein, teach communications systems which are mobile and carried by a user. U.S. Pat. No. 6,694,180 to Boesen describes biopotential sensing and medical monitoring which uses wireless communication to transmit the information from the sensors.

However, a human-machine interface that is convenient to use and is relatively inexpensive to manufacturer is still highly desirable.

SUMMARY OF THE INVENTION

Shown in a preferred embodiment of the present invention is a transmitting apparatus having a sensor for detecting an ear pull of a user and a laser worn by the user. An electronic module is coupled to both the ear pull sensor and the laser and generates a laser beam upon detection of the ear pull.

Also shown in a preferred embodiment of the present invention is a transmitting apparatus for a user which has a plurality of sensors for detecting a head position of the user, a RF transmitter and an electronic module coupled to the plurality of sensors and to the RF transmitter. The electronic module generates an encoded RF signal containing information about the head position of the user.

Further shown in a preferred embodiment of the invention is a communication apparatus including a portable computer worn by a user together with a microphone and speaker worn by the user and an electronic module. The electronic module is coupled to the microphone, the speaker and the portable computer and receives a voice message from the microphone and sends the voice message to the portable computing device, wherein the portable computing device, in response to the voice message, sends an answering audio communication to the electronic module which, in turn transfers the audio communication to the speaker.

Still further shown in a preferred embodiment of the present invention is a method for transmitting commands including sensing when an ear of a user is pulled back and turning on a laser mounted on the user when the sensing occurs.

OBJECTS OF THE INVENTION

It is, therefore, an object of the present invention to provide human-machine interface that is convenient to use and is relatively inexpensive to manufacture.

Another object is to provide a head worn communications device which communicates when a user pulls back one of his or her ears.

A further object is to provide a human-machine interface that will communicate with a plurality of devices.

A still further object of the present invention is to provide a method for communicating the head position of a user to other device.

An additional object of the present invention is to provide a hands free communication between a user and the internet.

In addition to the above-described objects and advantages of the present invention, various other objects and advantages will become more readily apparent to those persons who are skilled in the same and related arts from the following more detailed description on the invention, particularly, when such description is taken in conjunction with the attached drawing, figures, and appended claims.

DETAILED DESCRIPTION OF THE PREFERRED EMBODIMENT

Figure 1A:
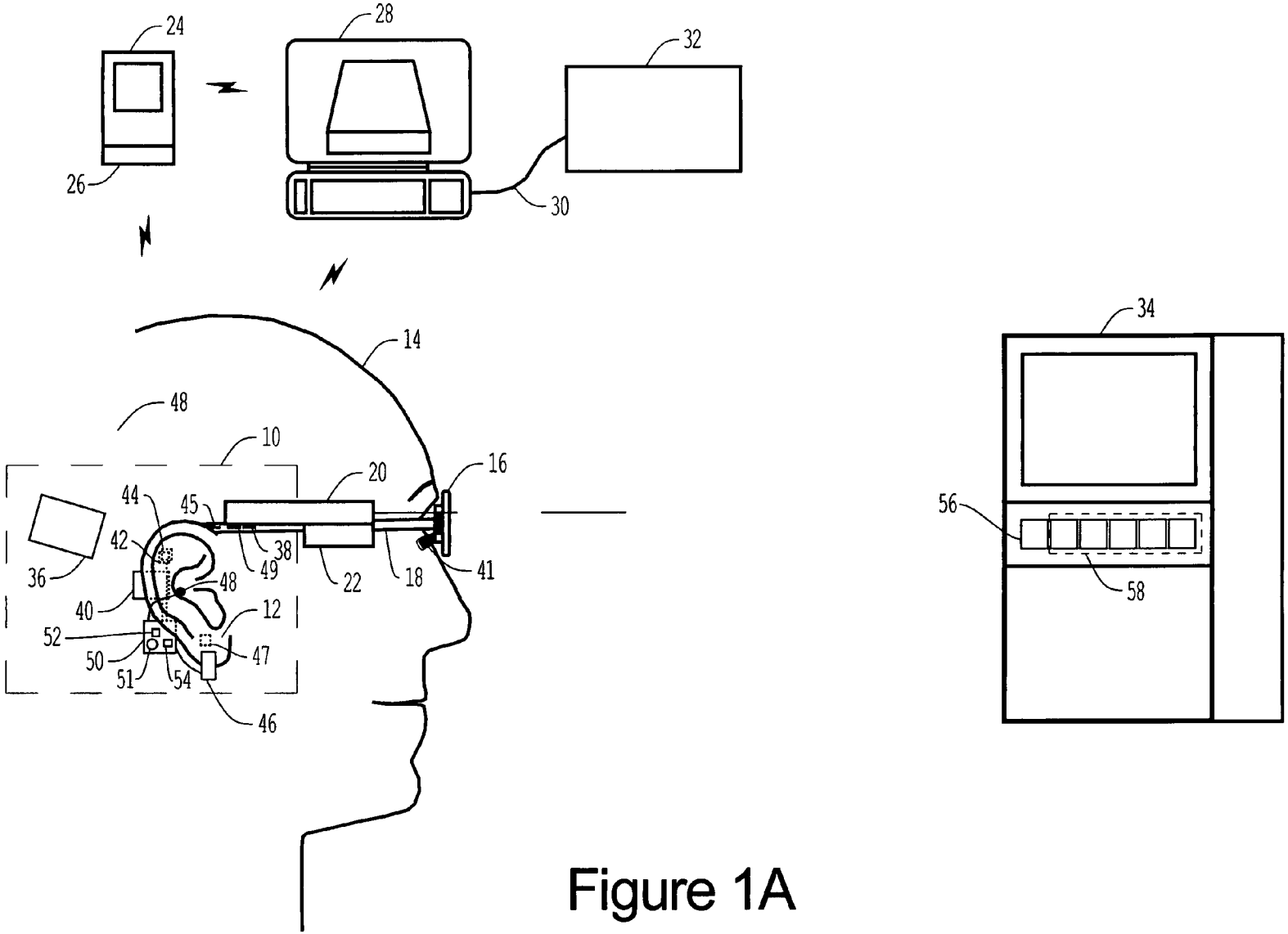
FIG. 1A is a block diagram of one embodiment of the human-machine interface of the present invention.

Prior to proceeding to a much more detailed description of the present invention, it should be noted that identical components which have identical functions have been identified with identical reference numerals throughout the several views illustrated in the drawing figures for the sake of clarity and understanding of the invention.

Turning now to the drawings, FIG. 1A shows several biometric devices inside a dashed line box 10 proximate to an ear 12 of an user 14. The user 14 also has a pair of glasses 16. Mounted on the temple piece 18 of the glasses 16 is a laser 20 and a camera 22. Also shown in FIG. 1A is a portable computing device which, in the preferred embodiment of the invention, is a personal data assistant (PDA) 24 with a location sensing device which, in the preferred embodiment of the invention, is a local positioning system (LPS) module or a global positioning system (GPS) module 26 attached thereto, a computer 28 connected by a cable 30 to the internet 32 and a TV set 34.

The biometric devices inside the dashed line box 10 include muscle actuation detectors which, in FIG. 1A, is a strain gauge 36 attached to the skin of the user 14, a second strain gauge 38 attached to or embedded in the temple piece 18, a third strain gauge 40 attached to the user's skin and positioned at least partially behind the ear 12 of the user 14, a fourth strain gauge 41 placed on the bridge of the glasses 16, capacitance plates 42 (attached to the back of the ear 12) and 44 (attached to the head behind the ear 12), an ear lobe clip 46 and a combination microphone and an ambient noise reducing speaker 48 placed inside the ear 12. Also shown is a RFID chip 47 placed underneath the skin of the user 14 behind the ear 12. The RFID chip could also be attached less intrusively by placing the RFID chip in an ear ring or in the ear clip 46, or attaching a RFID chip to the ear 12 by two magnets acting as a clamp. The capacitance plates 42 and 44, the strain gauges 36, 38 and 40 and the ear lobe clip 46 are connected by wires to an electronic module 50. The electronic module 50 contains a battery 51 to power the electronic module 50, two tilt meters 52, and a magnetic sensor 54. The two tilt meters 52 measure the tilt from horizontal from a direction from the back to the front of the user's head, and from a direction from one ear to the other ear. The magnetic sensor 54 senses the direction of the earth's magnetic field. The two tilt meters 52 and the magnetic sensor 54 are used to determine the position of the user's head.

The TV 34 has a laser light sensor 56 which responds in a predetermined manner upon detecting a laser light modulated with a predetermined code.

The system shown in FIG. 1A can operate in a number of different ways. In a relatively simple application, the user 14 aims the laser 20 at sensor 56 and wiggles or pulls back the ear 12 by pulling back the ear 12. Only one of the ear movement sensors 36, 38, 40 and the combination of the plates 42 and 44, is needed, for example strain gauge 38. Other ear movement detectors could also be used such as detectors that detect the change in capacitance between capacitor plates 44 and 45 or between plates 45 and 49, the capacitance between the body of the user 14 and capacitance plate 44 or between the frames of the glasses 16 and the capacitance plate 44. Also, the ear 12 movement can be detected by detecting a change in the magnitude of an RF field or a magnetic field using a detector in the electronic module 50. The RF generator or magnet could be located in the ear clip 46. Also the resistance of the user's skin proximate to the ear 12 would change sufficiently to detect an ear 12 movement. The strain gauge 38, together with the electronic module 50, detects the change of the strain in the temple piece 18 when the ear 12 is pulled back. When the ear movement is detected, the electronic module 50, connected to the laser generator 20 by wires hidden behind or inside the temple piece 18 of the glasses 16, causes the laser 20 to send the predetermined code which activates the sensor 56 to turn on or turn off the TV set 34. This simple application uses components that are relatively inexpensive to manufacture.

The laser 20 could have a beam which is narrow or which diverges to cover a larger area than a narrow beam. The laser 20 could have a variable divergence that the user could adjust. The laser 20 could also be replaced with other types of light sources such as an LED, LCD or a flashlight. Still other types of signaling means could be used such as an ultrasonic generator or a high frequency (i.e., 60 Ghz) transmitter which would generate a narrow RF signal could be used.

Other types of strain gauges, such as the flexible strain gauge shown in U.S. Pat. No. 6,360,615 to Smela which could be applied to the back of the ear 12.

Detecting the movement of the ear 12 using a capacitance detector can also be accomplished by attaching or embedding two capacitor plates in the temple piece 18 of the glasses 16 thereby eliminating the need to attach the capacitor plates to the skin of the user 14. The movement of the ear 12 can be detected by the change of capacitance between the two plates.

Figure 1B:
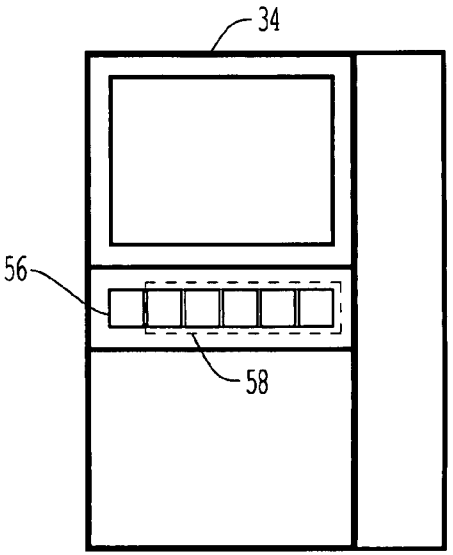
FIG. 1B is FIG. 1A with several elements removed to show one minimal configuration of the present invention.
Figure 1B:
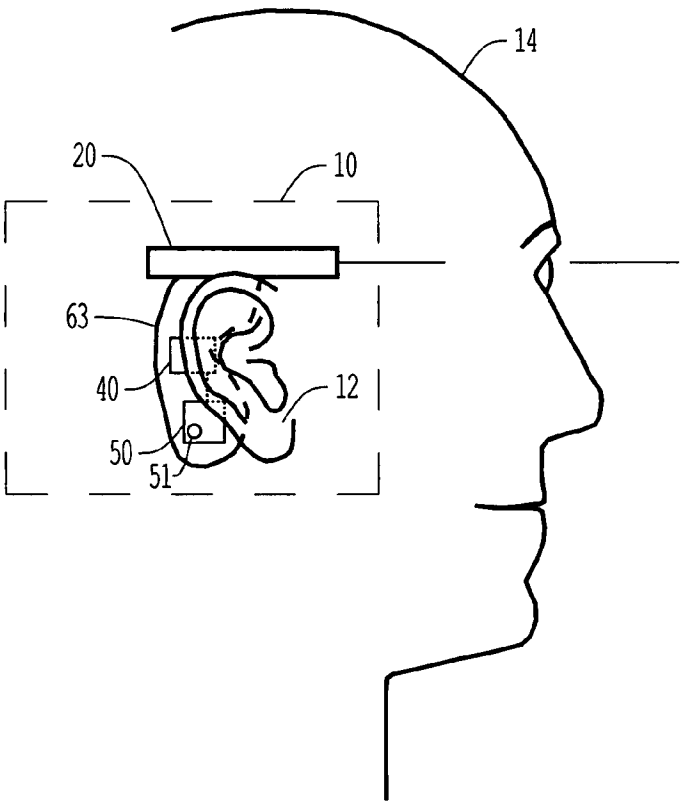

FIG. 1B shows a minimal configuration of the human-machine interface of the present invention which uses only the laser 20, strain gauge 40 and electronic module 50 to control the TV set 34. An ear bracket 63 is used to hold the human-machine interface components behind the ear 12 of the user 14.

Figure 1C:
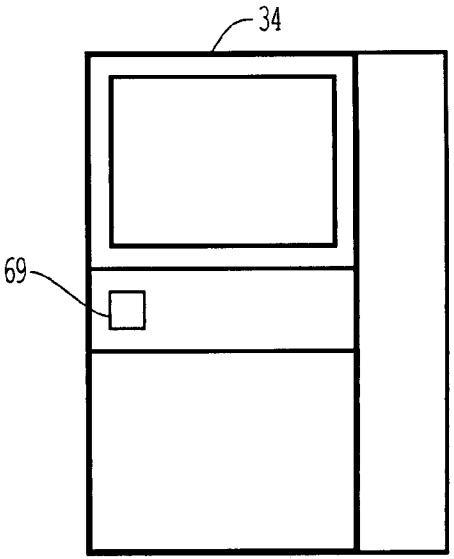
FIG. 1C shows an alternative embodiment in which a modulated retroflector is worn on each side of the head of a user 14.
Figure 1C:
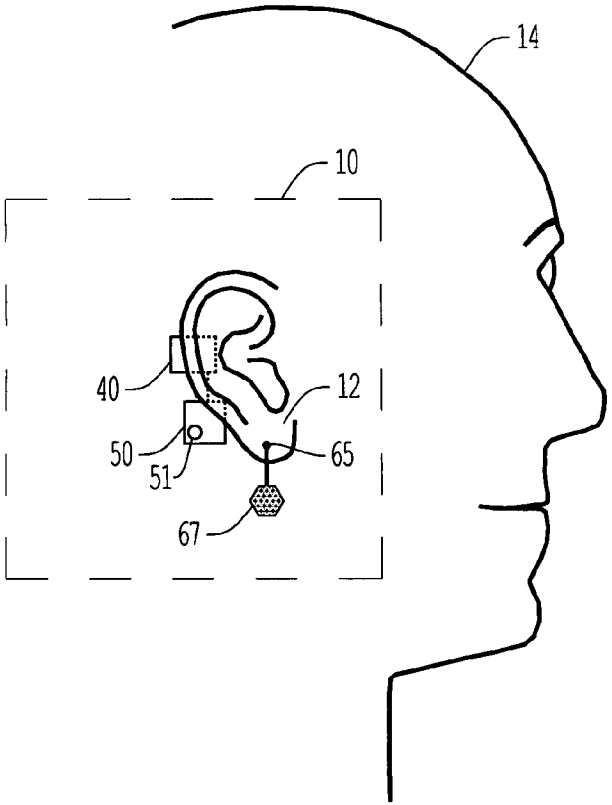

FIG. 1C shows an alternative embodiment where a modulated retroflector is worn on each side of the head of a user 14. The modulated retroflector shown in FIG. 1C is worn as a stud ear ring 65 or a dangle ear ring 67. The modulated retroflector 65, 67 could also be partially covered by placing the modulated retroflector 65, 67 in the hair of the user 14. In operation the TV set 34 would emit either a light signal or an RF signal from a combination transmitter and receiver 69. The signal from the combination transmitter and receiver 69 would be received by both of the modulated retroflectors 65, 67 on each side of the head of the user 14 when the user 14 is looking at the TV set 34, and at least one of the modulated retroflectors 65, 67 will not receive the signal if the user 14 is looking in another direction.

Each of the modulated retroflectors 65, 67 will, upon receipt of a signal from the combination transmitter and receiver 69 emit a light or RF signal which will be received by the combination transmitter and receiver 69. The combination transmitter and receiver 69 will be able to detect if both modulated retroflectors 65, 67 on the user 14 are responding by detecting differences in the signals sent by each modulated retroflector. Such differences could be different frequencies or codes sent by each modulated retroflector 65, 67. When the user 14 pulls back ear 12, the modulated retroflectors 65, 67 will change signals that the combination transmitter and receiver 69 will detect. If the combination transmitter and receiver 69 detects the change in signal from both modulated retroflectors 65, 67 the electronics in the TV set 34 will perform a predetermined procedure such as turning on the TC set 34.

The TV set 34 could have additional sensors 58 for controlling other TV functions such as volume control while the ear 12 is pulled back. The volume increases using one of the sensors 58 and decreases using another of the sensors 58. Two other of the sensors 58 could be used to select the TV channel in the same manner.

The electronic module 50 can communicate with the PDA 24 and the computer 28 by wireless communication such as the Bluetooth protocol. The computer 28 can, in turn, communicate with the internet 32. Using the combination microphone and speaker 48 the user 14 can send audio information to the electronic module 50 which can then digitize the audio signal and send it to the PDA 24 for voice recognition. If the audio is too complex for the PDA 24, the audio can be sent to the computer 28 for voice recognition. The computer 28 can access the internet 32 for help in the voice recognition if necessary. Finally if none of the equipment in FIG. 1A can recognize the audio, the PDA communicating to the electronic module 50 and the combination microphone and speaker 48 can tell the user 14 to repeat the statement or can ask specific questions of the user 14 which the user 14 can answer by pulling back the ear 12 either once or twice to answer a yes or no question.

There could also be a set of predetermined voice commands that the user 14 is restricted to. The voice recognition software to recognize the limited list of commands is less complex and more accurate than the software needed to recognize all words. Such voice commands as "channel 59"

when the ear 12 is pulled back would be decoded either directly by the electronic module 50 or by the PDA 24, encoded and sent back to the electronic module 50 which would, in turn, modulate the laser beam from the laser 20 with the correct code which the sensor 56 would decode and the TV set 34 would change the channel to channel 59. The laser beam would therefore have to aimed at the sensor 56 to transmit the encoded laser beam signal to the TV set 34. The same sequence could be used to set a thermostat, a VCR, etc.

There are some operations which do not require the use of the laser 20. For example a user 14 could say "time" while pulling back the ear 12 and the time in an audio format would be sent to the speaker in the combination microphone and speaker 48. Also, a telephone number could be spoken and a telephone call would be made, and the call could be terminated when the user 14 says "hang up".

In this manner more complex commands and communication can be achieved such as using the biometric device and system to simply record an audio message to communicating to any other applications such as viewing and taking a picture of a home appliance that needs repair and having the PDA 24, the computer 28 and the internet recognize the appliance and providing information needed to repair the appliance.

The laser 20 can be used to send commands to or query many products such as notifying a traffic light that the user wants to cross the street along with the amount of time the user needs to cross the street. The laser could also be used by emergency personnel to cause traffic lights to turn green for them when they are going to an emergency.

Pulling the ear 12 back can simply be a single pull or can be a more complex action such as pulling back and holding the ear 12 back until a object, such as a TV, reaches a desired set point, such as reaching the wanted channel. Other actions can be to pull back the ear 14 twice within 2 seconds, etc. Even more complex movements can be used such as movements which may resemble Morse code signals or be actual Morse code. It is believed that some individuals with training can eventually control the movement of either ear separately and independently, thus generating a user interface capable of even more selectivity, complexity and discrimination.

Also, for a novice user the ear can be pushed back by hand until the user develops the ability to pull back his or her ear without using a hand.

The ear clip 46 can be used to monitor the user's physical condition such as pulse rate and pulse oximetry. Other sensors can be attached to the user and wired to the electronic module 50 such as an accelerometer for monitoring other body parameters such as whether the user 14 has a fever on not and whether the person is awake, has fallen, etc.

A simple driving drowsiness detector can be made by having the electronic module 50 issue sporadic random tones to the user 14 using the combination microphone and speaker 48 and requiring the user 14 to respond with an ear wiggle movement at that time. The response delay would indicate the level of a user's reflex time and degree of sleepiness. A prolonged delay would result in a much louder tone to wake up the user 14.

Using a camera, either the camera 22 or another camera, the user 14 could pull back the ear 12 and say "camera mode" to tell the electronic module 50 to cause the camera to take a picture when the ear 12 is pulled back. Other camera mode activation means could be used such as a sequence of ear pulls. If the camera is a stand alone camera and the orientation of the camera can be remotely controlled, the tilt sensors 52 and magnetic sensor 54 would be used to detect the what area the user 14 is looking at, and the camera would also point at the same area. Thus the user 14 at a sporting event could aim the camera and command the camera to take a picture simply by looking in the desired direction and pulling the ear 12 back to take a picture.

The combination microphone and speaker 48 could also contain an actuator which would provide tactile signaling for situations such as when the ambient noise is too high for reliable communication using the combination microphone and speaker 48 alone. The tactile signaling could be a signal touch or could be a pattern of touches.

The electronic module 50 and the combination microphone and speaker 48 could be used as a cell phone with the proper electronics inside the module 50.

Figure 2:
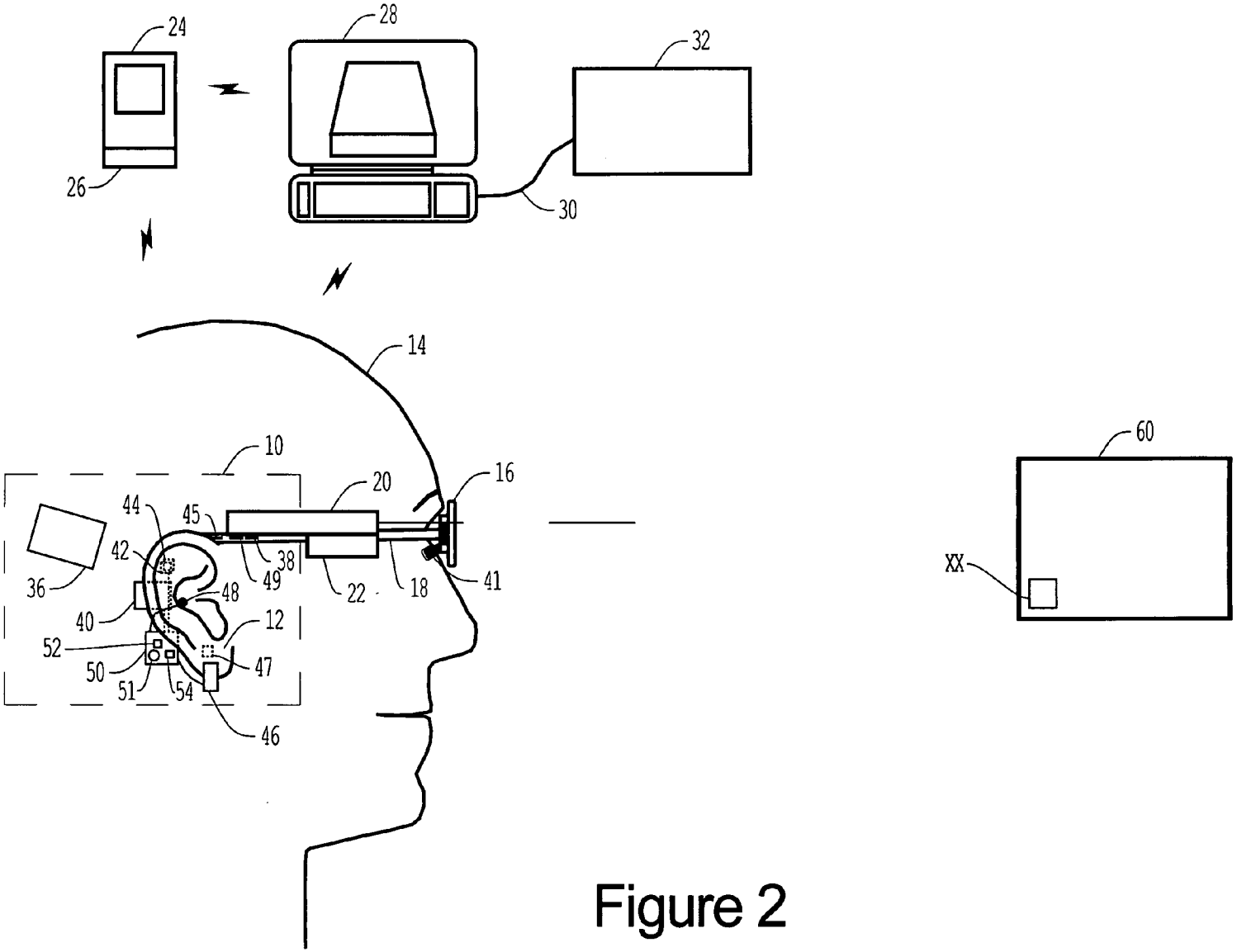
FIG. 2 is FIG. 1A modified to show other types of devices that can be used with the human-machine interface of the present invention.

FIG. 2 shows the biometric system of FIG. 1A, but is more generalized as to devices that the laser beam can be used on. The target 60 can be a stereo sound system with detectors to enable selecting a particular station, the type of music the user wants to hear, an appliance which needs repair as discussed above, a VCR, a lamp, a thermostat or a burglar alarm system, for example. The target 60 could be a refrigerator or a drawer having a laser detection device which, when queried, would provide an audio or digital feedback as to the contents of the refrigerator or drawer. The target 60 could be a door lock which would open when a correctly encoded laser signal is beamed to its detector. Of course the predetermined signal could be sent via an RF signal rather than by the laser 20. In FIG. 2 the laser 20 of FIG. 1A could be modified to detect bar code labels. The reading of bar codes and the connections to the internet could provide information about a product which can not obtained by observing the product alone.

The target 60 could have a sensor 61 which would receive light or RF signals from the user 14. In this embodiment the user 14 would compose a message and enter the message as an audio signal which would be stored in the PDA 24, electronic module 50 or a storage device shown as element 38 for this embodiment. When the user 14 approaches the target 60 and pulls back ear 12, the stored message is sent as an audio message or a binary message to the sensor 61 and the target 60 will either immediately respond to the message or will store the message for later retrieval.

The target 60 could be a luminescent screen which could be written on with the laser 20 when it emits a blue light.

Figure 3:
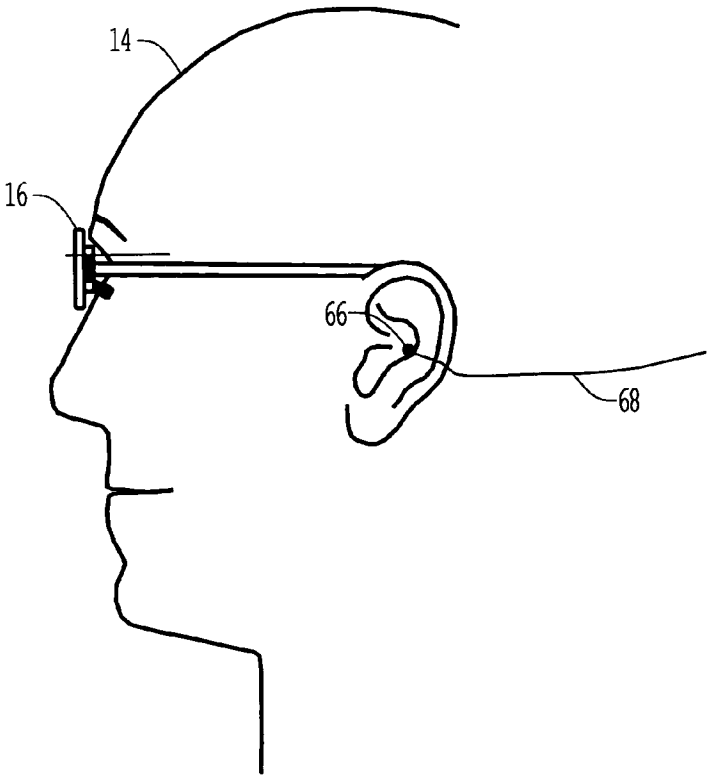
FIG. 3 shows two sides of a user's head.
Figure 3:
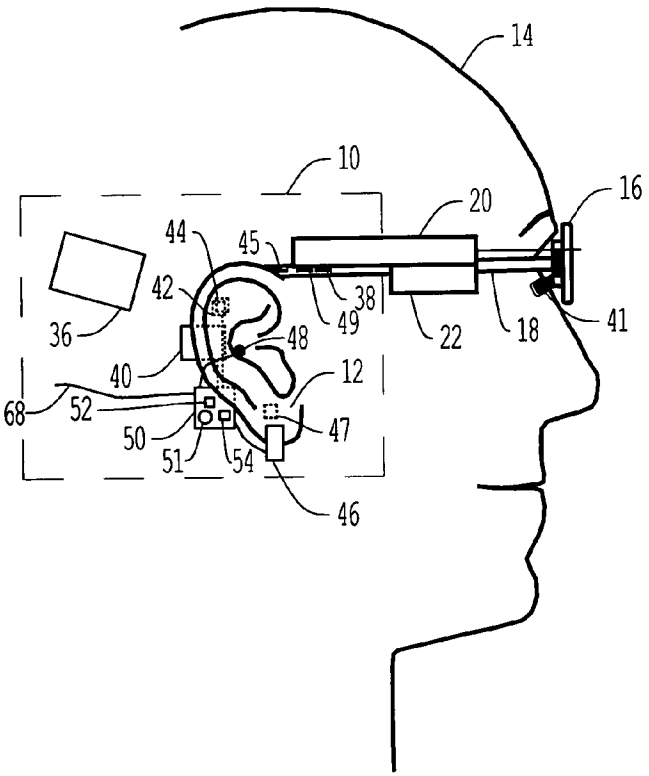

FIG. 3 shows the microphone 64 of the combination microphone and speaker 48 of FIG. 1A placed in one ear and the speaker 66 placed in the other ear. The speaker 66 is connected to the electronic module 50 by a sire 68. The use of the microphone 64 in one ear and the speaker 68 in the other ear attenuates the feedback from the speaker to the microphone in the combination microphone and speaker 48 of FIG. 1A.

Figure 4:
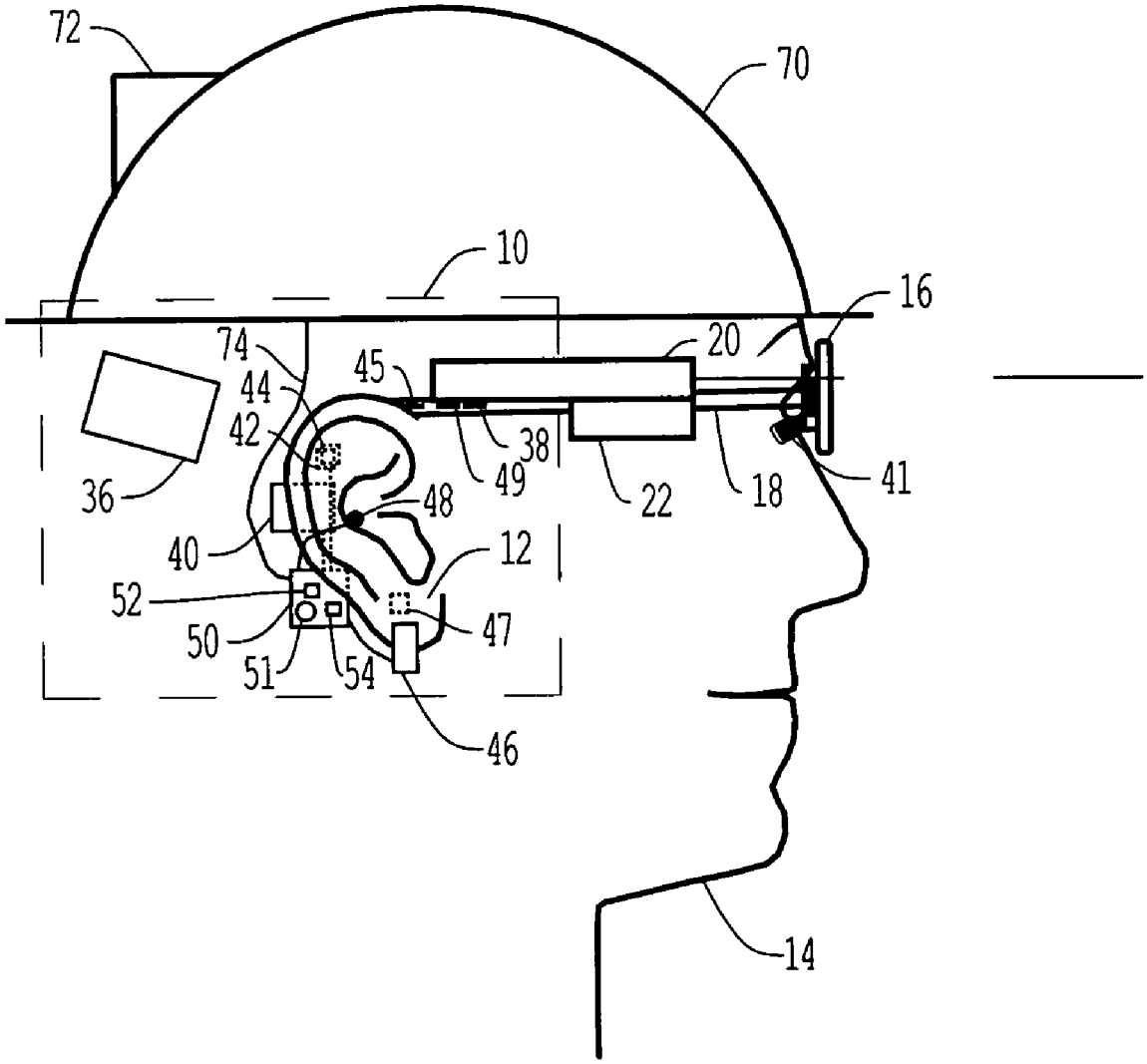
FIG. 4 is the user of FIG. 1A wearing a helmet with a laser detector mounted on the helmet.

FIG. 4 shows the biometric devices and system of FIG. 1A with the addition of a helmet 70 which soldiers or firemen might use. The helmet 70 has a laser light detector 72 on the back of the helmet and a wire 74 from the helmet 70 to the electronic module 50. The laser light detector 72 allows another person with essentially the same equipment to communicate with the user 14 by aiming the other person's laser light at the laser light detector 72. The apparatus of FIG. 4 allows for secure communication from one person to another, and allows communication when there is a high degree of ambient noise since the combination microphone and speaker 48 are in the ear channel which allows the words of the sender to be detected without much ambient noise and the receiver to receive the communication directly into his ear. The ear 12 can still receive normal voice communication.

The identity of a user 14 can be verified using the RFID chip 47. The electronic module 50 would query the RFID chip 47 to verify the identity of the user.

Although the invention has been described in part by making detailed reference to a certain specific embodiment, such detail is intended to be, and will be understood to be, instructional rather than restrictive. It will be appreciated by those skilled in the art that many variations may be made on the structure and mode of operation without departing from the spirit and scope of the invention as disclosed in the teachings contained herein.

I claim:

1. A transmitting apparatus comprising:

a) an ear movement sensor disposed in a predetermined position adjacent an ear of a user for detecting an ear movement of said user; and b) an electronic module coupled to said ear movement sensor for initiating a predetermined procedure for at least one of initiating, stopping and maintaining a predetermined object upon a detection of said ear movement.

2. The transmitting apparatus, as set forth in claim 1, further including signaling means comprising one of a light source, an ultrasonic generator and a high frequency transmitter wherein said electronic module is coupled to said signaling means and enables said signaling means upon detection of said ear movement.

3. The transmitting apparatus, as set forth in claim 2, wherein said ear movement is an ear pull.

4. A transmitting apparatus comprising:

a) a sensor for detecting an ear pull of a user;

b) a laser worn by said user;

c) an electronic module coupled to said sensor and said laser for generating an encoded laser beam upon a detection of said ear pull.

5. The transmitting apparatus, as set forth in claim 4, wherein said laser is mounted on the head of said user.

6. The transmitting apparatus, as set forth in claim 4, further including a plurality of head position sensors for detecting a head position of said user.

7. The transmitting apparatus, as set forth in claim 4, further including a laser detector mounted on said user for receiving communication from another laser.

8. A transmitting apparatus comprising:

a) a user;

b) a plurality of sensors for detecting a head position of said user;

c) a RF transmitter; and c) an electronic module coupled to said plurality of sensors and to said RF transmitter for generating an encoded RF signal containing information about said head position of said user.

9. The transmitting apparatus, as set forth in claim 8, further including a speaker coupled to said electronic module wherein if said electronic module detects one of a particular head position and a pattern of movement of said head position, a tone is sent to said speaker to alert said user.

10. A transmitting apparatus comprising:

a) a sensor for detecting an ear movement of a user;

b) an electronic module coupled to said ear movement sensor for starting a procedure upon a detection of said ear movement; and c) signaling means comprising one of a light source, an ultrasonic generator and a high frequency transmitter wherein said electronic module is coupled to said signaling means and enables said signaling means upon detection of said ear movement initiated by pulling on an ear of such user.

11. The transmitting apparatus, as set forth in claim 10, wherein said signaling means is mounted on the head of said user.

12. The transmitting apparatus, as set forth in claim 10, further including one or more head position sensors for detecting a head position of said user.

13. The transmitting apparatus, as set forth in claim 10, wherein said ear pull sensor comprises a strain gauge one of attached to and contained inside a temple piece of a pair of glasses worn by said user.

14. The transmitting apparatus, as set forth in claim 10, wherein said ear pull sensor comprises two capacitance plates, wherein the capacitance formed between said two capacitance plates changes when said ear is moved.

15. The transmitting apparatus, as set forth in claim 14, wherein one capacitor plate is the frame of a pair of glasses worn by said user.

16. The transmitting apparatus, as set forth in claim 11, wherein one capacitor plate is the body of said user.

* * * * *